US005218824A

United States Patent [19]

Cederwall et al.

[11] Patent Number: 5,218,824

[45] Date of Patent: Jun. 15, 1993

[54] LOW EMISSION COMBUSTION NOZZLE FOR USE WITH A GAS TURBINE ENGINE

[75] Inventors: Philip J. Cederwall; Kenneth O. Smith, both of San Diego, Calif.

[73] Assignee: Solar Turbines Incorporated, San Diego, Calif.

[21] Appl. No.: 904,312

[22] Filed: Jun. 25, 1992

[51] Int. Cl.[5] ..... F23R 3/32

[52] U.S. Cl. ..... 60/737; 60/742; 60/748; 239/403; 239/419.3; 239/427.5

[58] Field of Search ..... 60/737, 740, 742, 748, 60/39.463; 239/403, 405, 419, 419.3, 424.5, 432, 427.5, 533.2, 399

[56] References Cited

U.S. PATENT DOCUMENTS

| | | | |
|---|---|---|---|
| 2,954,172 | 9/1960 | Grundman | 239/443 |
| 3,285,007 | 11/1966 | Carlisle | 60/39.74 |
| 3,483,700 | 12/1969 | Ryberg | 60/39.74 |
| 3,684,186 | 8/1972 | Helmrich | 239/400 |
| 3,691,765 | 9/1972 | Carlisle | 60/39.74 |
| 3,713,588 | 1/1973 | Sharpe | 60/742 |
| 3,866,413 | 2/1975 | Sturgess | 60/39.74 |
| 3,906,718 | 9/1975 | Wood | 60/39.65 |
| 4,002,297 | 1/1977 | Pillard | 239/432 |
| 4,311,277 | 1/1982 | Stratton | 239/403 |
| 4,327,547 | 5/1982 | Hughes | 60/39.46 |
| 4,337,618 | 7/1982 | Hughes | 60/39.55 |
| 4,463,568 | 8/1984 | Willis | 60/742 |
| 4,562,698 | 1/1986 | Halvorsen | 60/740 |
| 4,587,809 | 5/1986 | Ohmori et al. | 60/748 |
| 4,600,151 | 7/1986 | Bradley | 239/400 |
| 4,790,480 | 12/1988 | Rennie | 239/125 |
| 4,798,330 | 1/1989 | Mancini | 239/8 |
| 4,850,194 | 7/1989 | Füglistaller et al. | 60/742 |
| 4,854,127 | 8/1989 | Vinson | 60/742 |
| 4,938,417 | 7/1990 | Halvorsen | 239/5 |
| 4,948,055 | 8/1990 | Belcher | 239/419.5 |
| 4,962,889 | 10/1990 | Halvorsen | 239/410 |
| 4,977,740 | 12/1990 | Madden | 60/39.463 |
| 4,999,996 | 3/1991 | Duchene | 60/39.32 |
| 5,014,918 | 5/1991 | Halvorsen | 239/410 |
| 5,101,633 | 4/1992 | Keller et al. | 60/737 |
| 5,145,359 | 9/1992 | Ancona et al. | 239/405 |

FOREIGN PATENT DOCUMENTS

| | | | |
|---|---|---|---|
| 0122526 | 5/1987 | European Pat. Off. . | |
| 1067717 | 5/1967 | United Kingdom | 239/403 |
| 2021254 | 11/1979 | United Kingdom | 239/419.3 |

*Primary Examiner*—Richard A. Bertsch
*Assistant Examiner*—Timothy S. Thorpe
*Attorney, Agent, or Firm*—Larry G. Cain

[57] ABSTRACT

The known systems and injector nozzles for reducing NOx in the combustion systems of past gas turbine engines has generally failed to effectively and efficiently reduce the NOx level. The present system reduces the formation of NOx within the combustion zone by controlling the air/fuel ratio and more explicitly by controlling the air portion of the air/fuel ratio. The present injector nozzle includes a device for introducing a primary supply of air through the injector nozzle which is sized to have a predetermined cross-sectional area. The injector nozzle further includes a device for introducing a secondary supply of air through the injector nozzle which is sized to have a predetermined area. A device for introducing a primary supply of air through the injector at a controlled rate and a device for passing a main source of fuel through the injector nozzle at a controlled rate relative to the quantity of primary supply of air. The system with the injector nozzle provides an economical, reliable and effective method for reducing and controlling the amount of nitrogen oxide (NOx), carbon monoxide (CO) and unburned hydrocarbon (UHC) emitted from the gas turbine engine.

17 Claims, 4 Drawing Sheets

LOW EMISSION COMBUSTION NOZZLE FOR USE WITH A GAS TURBINE ENGINE

TECHNICAL FIELD

The present invention relates to a low emission combustion fuel injector nozzle. More particularly, the invention relates to a combustion nozzle for controlling the combustion air to be mixed with the fuel to control the air to fuel ratio.

BACKGROUND ART

The use of fossil fuel as the combustible fuel in gas turbine engines results in the combustion products of carbon monoxide, carbon dioxide, water vapor, smoke and particulates, unburned hydrocarbons, nitrogen oxides and sulfur oxides. Of these above products, carbon dioxide and water vapor are considered normal and unobjectionable. In most applications, governmental imposed regulations are restricting the amount of pollutants being emitted in the exhaust gases.

In the past the majority of the products of combustion have been controlled through design modifications and fuel selection. For example, at the present time smoke has normally been controlled by design modifications in the combustor, particulates are normally controlled by traps and filters, and sulfur oxides are normally controlled by the selection of fuels being low in total sulfur. This leaves carbon monoxide, unburned hydrocarbons and nitrogen oxides as the emissions of primary concern in the exhaust gases being emitted from the gas turbine engine.

Oxides of nitrogen are produced in two ways in conventional combustion systems. For example, oxides of nitrogen are formed at high temperatures within the combustion zone by the direct combination of atmospheric nitrogen and oxygen and by the presence of organic nitrogen in the fuel. The rates with which nitrogen oxides form depend upon the flame temperature and, consequently, a small reduction in flame temperature can result in a large reduction in the nitrogen oxides.

Past and some present systems providing means for reducing the maximum temperature in the combustion zone of a gas turbine combustor have included schemes for introducing more air at the primary combustion zone, recirculating cooled exhaust products into the combustion zone and injecting water spray into the combustion zone. An example of such a system is disclosed in U.S. Pat. No. 4,733,527 issued on Mar. 29, 1988 to Harry A. Kidd. The method and apparatus disclosed therein automatically maintains the NOx emissions at a substantially constant level during all ambient conditions and for no load to full load fuel flows. The water/fuel ratio is calculated for a substantially constant level of NOx emissions at the given operating conditions and, knowing the actual fuel flow to the gas turbine, a signal is generated representing the water metering valve position necessary to inject the proper water flow into the combustor to achieve the desired water/fuel ratio.

An injector nozzle used with a water injection system is disclosed in U.S. Pat. No. 4,600,151 issued on Jul. 15, 1986 to Jerome R. Bradley. The injector nozzle disclosed includes an annular shroud means operatively associated with a plurality of sleeve means one inside the other in spaced apart relation. The sleeve means form a liquid fuel-receiving chamber, a water or auxiliary fuel-receiving chamber inside the liquid fuel-receiving chamber for discharging water or auxiliary fuel in addition or alternatively to the liquid fuel, an inner air-receiving chamber for receiving and directing compressor discharge air into the fuel spray cone and/or water or auxiliary fuel to mix therewith from the chamber for receiving and directing other compressor discharge air into the fuel spray cone and/or water or auxiliary fuel from the outside for mixing purposes.

Another example of a fuel injector for a gas turbine engine is disclosed in U.S. Pat. No. 4,463,568 issued on Aug. 7, 1984 to Jeffrey D. Willis et. al. In this patent, a dual fuel injector is arranged to maintain pre-determined air fuel ratios in adjacent upstream and downstream opposite handed vortices and to reduce the deposition of carbon on the injector. The injector comprises a central duct, a deflecting member, a first radially directed outlet, a shroud which defines an annular duct, and a second radially directed outlet. The ducts receive a supply of compressed air, the central duct receives gaseous fuel from an annular nozzle and the annular duct receives liquid fuel from a set of nozzles. When the injector is operating on liquid fuel, the fuel and air mixture issues from the second outlet and compressed air flows from the first outlet and prevents migration of fuel between the two vortices, thereby maintaining a rich air fuel ratio in the upstream vortex which reduces the emissions of NOx. Also, the flow of air from the first outlet reduces the deposition of carbon from the liquid fuels on the deflecting member.

Another fuel injector is disclosed in U.S. Pat. No. 4,327,547 issued May 4, 1982 to Eric Hughes et. al. The fuel injector includes means for water injection to reduce NOx emissions and an outer annular gas fuel duct with a venturi section with air purge holes to prevent liquid fuel entering the gas duct. Further included is an inner annular liquid fuel duct having inlets for water and liquid fuel and through which compressor air flows. The inner annular duct terminates in a nozzle, and a central flow passage through which compressed air also flows, terminating in a main diffuser having an inner secondary diffuser. The surfaces of both diffusers are arranged so that their surfaces are washed by the compressed air to reduce or prevent the accretion of carbon to the injector, the diffusers in effect forming a hollow pintle.

Another combustor apparatus for use with a gas turbine engine is disclosed in U.S. Pat. No. 3,906,718 issued on Sep. 23, 1975 to Robert D. Wood. In this patent, a combustion chamber for a gas turbine engine which has staged combustion in two toroidal vortices of opposite hand arranged one upstream of the other is disclosed. A burner delivers air/fuel mixture in a radial direction to support the vortices and the burner has a convergent outlet for the air/fuel mixture.

The above system and nozzles used therewith are examples of attempts to reduce the emissions of oxides of nitrogen. Many of the attempts have resulted in additional expensive components. For example, the Kidd concept requires an additional means for injecting water into the combustion chamber which includes a water source, a control valve, a controlling and monitoring system and a device for injecting water into the combustion chamber.

DISCLOSURE OF THE INVENTION

In one aspect of the invention, a fuel injector nozzle has a central axis and is comprised of a generally cylindrical outer casing coaxially positioned about the central axis. The outer casing has a first end, a second end and a wall defining an inner surface and an outer surface. The wall further has an aperture defined therein extending between the inner surface and the outer surface while being positioned near the first end. An outer tubular member has a passage therein, is positioned in the aperture and is attached to the casing. A plate is positioned at the first end and is attached to the casing. The plate has a plurality of passages. An inner member is coaxially positioned about the central axis within the outer casing. The casing includes a main body having a first end attached to the plate, a second end and an external stepped surface. The casing further includes an end cap having a first end attached to the second end of the main body, a second end and a concave inner surface formed within the end cap. The casing further includes a generally cylindrical shell coaxially positioned about the central axis and has a first end attached to the external stepped surface intermediate the first and second ends. The shell has a second end and a plurality of holes radially positioned and evenly spaced about the shell. A means for passing a pilot fuel through the injector nozzle and a means for introducing a supply of pilot air through the injector nozzle during operation of the injector nozzle are included. A means for introducing a primary supply of air through the injector nozzle and a means for passing a main source of fuel through the injector nozzle during operation thereof are included.

In another aspect of the invention, a dual fuel injector nozzle is comprised of a central axis and is comprised of a generally cylindrical outer casing coaxially positioned about the central axis. The outer casing has a first end, a second end and a wall defining an inner surface and an outer surface. The wall further has an aperture defined therein extending between the inner surface and the outer surface while being positioned near the first end. An outer tubular member has a passage therein, is positioned in the aperture and is attached to the casing. A plate is positioned at the first end and is attached to the casing. The plate has a plurality of passages. An inner member is coaxially positioned about the central axis within the outer casing. The casing includes a main body having a first end attached to the plate, a second end and an external stepped surface. The casing further includes an end cap having a first end attached to the second end of the main body, a second end and a concave inner surface formed within the end cap. The casing further includes a generally cylindrical shell coaxially positioned about the central axis and has a first end attached to the external stepped surface intermediate the first and second ends. The shell has a second end and a plurality of holes radially positioned and evenly spaced about the shell. A means for passing a pilot fuel through the injector nozzle and a means for introducing a supply of pilot air through the injector nozzle during operation of the injector nozzle are included. A means for introducing a primary supply of air through the injector nozzle, a means for passing a main source of fuel through the injector nozzle and a means for passing a source of liquid fuel through the injector nozzle during operation thereof are included.

The injector nozzle is constructed and sized to functionally control the air passing therethrough to automatically maintain and control gas turbine nitrogen oxide, carbon monoxide and unburned hydrocarbon emissions at a specific level during all conditions for no load to full or high load operating parameters.

BEST MODE FOR CARRYING OUT THE INVENTION

Figure 1:
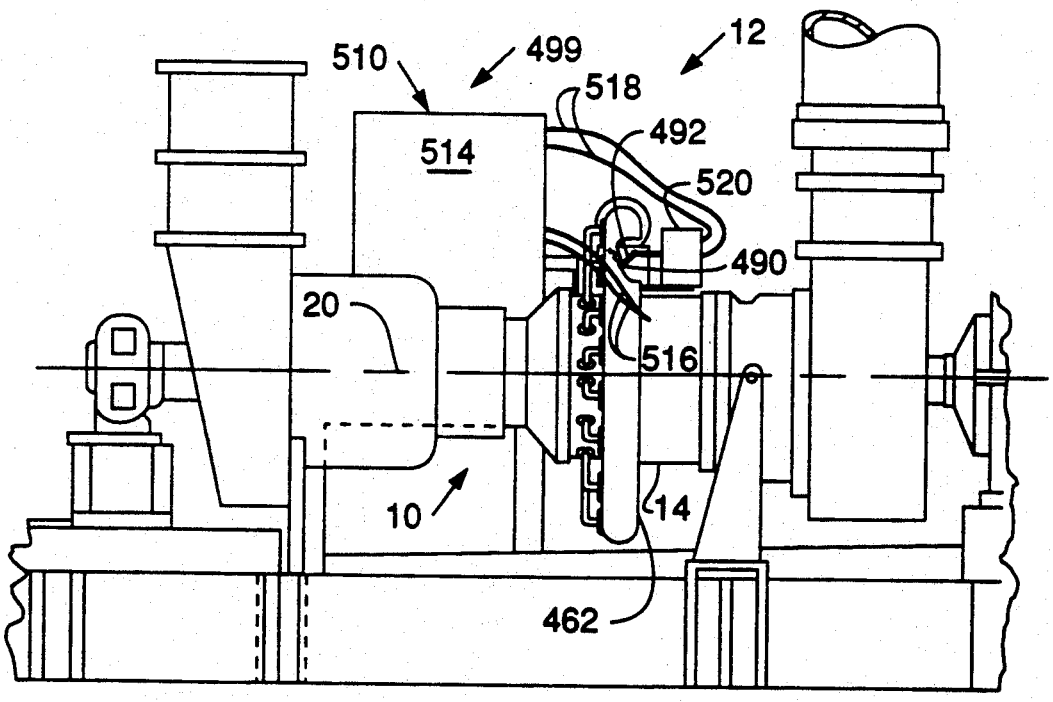
FIG. 1 is an external view of a gas turbine engine and control system having an embodiment of the present invention.
Figure 2:
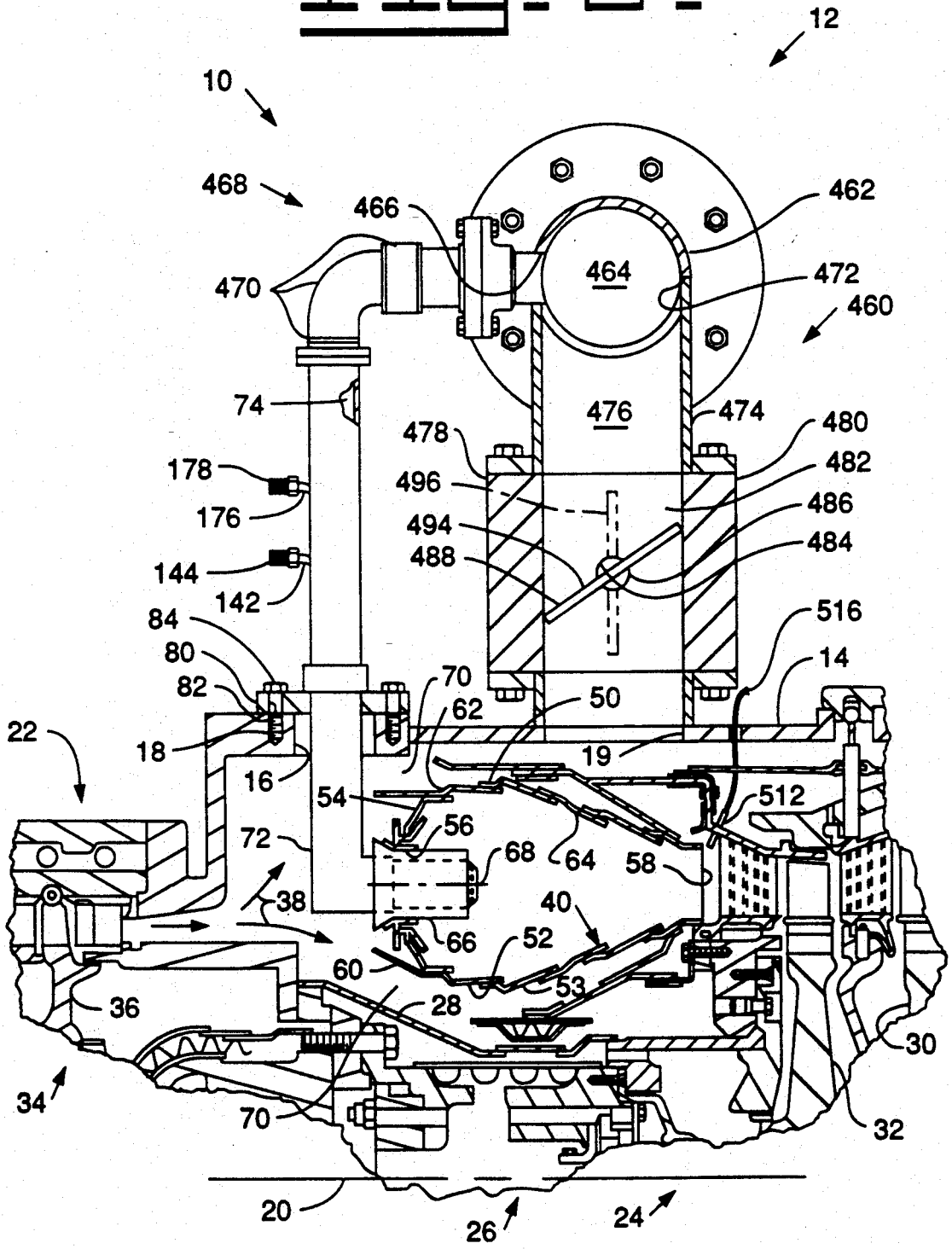
FIG. 2 is a partially sectioned side view of a gas turbine engine having an embodiment of the present invention.

In reference to FIG. 1 and 2, a gas turbine engine 10 having a control system 12 for reducing nitrous oxide emissions therefrom is shown. The gas turbine engine 10 has an outer housing 14 having therein a plurality of openings 16 having a preestablished position and relationship one to another. A plurality of threaded holes 18 are positioned relative to the plurality of openings 16. The housing 14 further includes at least a single aperture 19 therein and a central axis 20. The housing 14 is positioned about a compressor section 22 centered about the axis 20, a turbine section 24 centered about the axis 20 and a combustor section 26 positioned operatively between the compressor section 22 and the turbine section 24.

The engine 10 has an inner case 28 coaxially aligned about the axis 20 and is disposed radially inwardly of the compressor section 22, turbine section 24 and the combustor section 26. The turbine section 24 includes a power turbine 30 having an output shaft, not shown, connected thereto for driving an accessory component such as a generator. Another portion of the turbine section 24 includes a gas producer turbine 32 connected in driving relationship to the compressor section 22. The compressor section 22, in this application, includes an axial staged compressor 34 having a plurality of rows of rotor assemblies 36, of which only one is shown. When the engine 10 is operating, the compressor 34 causes a flow of compressed air exiting therefrom designated by the arrows 38. As an alternative, the compressor section 22 could include a radial compressor or any source for producing compressed air. In this application, the combustor section 26 includes an annular combustor 40 being radially spaced a preestablished distance from the outer housing 14 and the inner case 28. Other combustor geometries may be equally suitable. The combustor 40 is supported from the inner case 28 in a conventional manner. The combustor 40 has a generally cylindrical outer shell 50 being coaxially positioned about the central axis 20, a generally cylindrical inner shell 52 having an outer surface 53 being coaxial with the outer shell 50, an inlet end 54 having a plurality of generally evenly spaced openings 56 therein and an outlet end 58. In this application, the combustor 40 is constructed of a plurality of generally conical or cylindrical segments 60. The outer shell 50 has an outer surface 62 and an inner surface 64 extending generally between the inlet end 54 and the outlet end 58. Each of the openings 56 has an injector nozzle 66 having a central axis 68 positioned therein, in the inlet end 54 of the combustor 40. The area between the outer housing 14 and the inner case 28, less the area of the combustor section 26, forms a preestablished flow or cooling area 70 through a portion of the compressed air 38 will flow. In this application, approximately 50 to 70 percent of the compressed air 38 is used for cooling. As an alternative to the annular combustor 40, a plurality of can type combustors could be incorporated without changing the gist of the invention.

Figure 3:
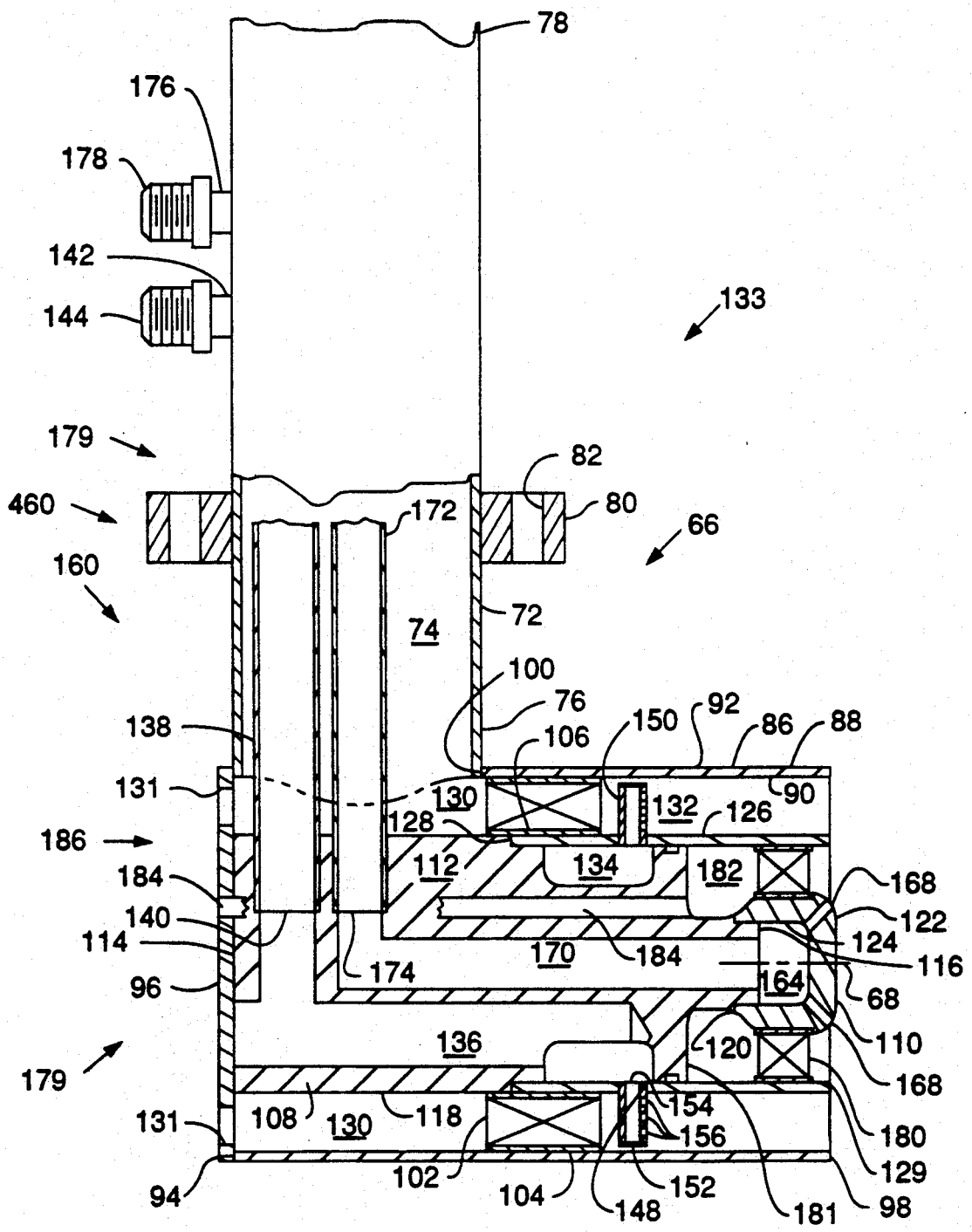
FIG. 3 is an enlarged sectional view of a single fuel injector used in one embodiment of the present invention.

As best shown in FIG. 3, in this application each of the injectors 66 are of the single gaseous fuel type. Each of the injectors 66 is supported from the housing 14 in a conventional manner. For example, an outer tubular member 72 has a passage 74 therein. The tubular member 72 includes an outlet end portion 76 and an inlet end portion 78. The tubular member 72 extends radially through one of the plurality of openings 16 in the outer housing 14 and has a mounting flange 80 extending therefrom. The flange 80 has a plurality of holes 82 therein in which a plurality of bolts 84 threadedly attach to the threaded holes 18 in the outer housing 14. Thus, the injector 66 is removably attached to the outer housing 14. The injector 66 includes a generally cylindrical outer casing 86 having a wall 88 defining an inner surface 90 and an outer surface 92. The casing 86 is coaxially positioned about the central axis 68 and has a first end 94 closed by a plate 96 and a second open end 98. An aperture 100 defined in the wall 88 has the tubular member 72 fixedly attached therein. The aperture 100 is defined near the first end 94 and extends between the outer surface 92 and the inner surface 90. A plurality of primary air swirlers 102 each have a preestablished length and shape and an outer portion 104 generally evenly positioned about and attached to the inner surface 90 of the casing 86 intermediate the aperture 100 and the second end 98. An inner portion 106 of each of the plurality of swirlers 102 is attached to an inner member 108 which is coaxially positioned about the central axis 68. The inner member 108 includes an end cap 110 and a main body 112 having an upstream or first end 114, a second end 116 and an external stepped surface 118 extending between the ends 114,116. The first end 114 of the main body 112 is also attached to the plate 96 or as an alternative may be integrally formed therewith. The end cap 110 includes a first end 120, a second end 122 and a concave inner surface 124 extending from the first end 120 toward the second end 122. The first end 120 of the end cap 110 is attached to the main body 112 near the second end 116.

The inner member 108 further includes a generally cylindrical shell 126 coaxially positioned about the central axis 68 and having a first end 128 and a second end 129. The first end 128 is attached to the the main body 112 intermediate the first and second ends 114,116 thereof. A first chamber 130 is defined by the end plate 96, a portion of the inner surface 90 of the casing 86, the plurality of swirlers 102 and a portion of the external surface 118 of the main body 112. A plurality of holes or passages 131 in the plate 96 communicate with the first chamber 130 and have a combined predetermined total area. A second chamber or main air passage 132 is defined by the plurality of swirlers 102, a portion of the inner surface 90 of the casing 86, a portion of the shell 126 and the second open end 98 of the casing 86 and the second end 129 of the shell 126. The second chamber or main air passage 132 has a predetermined cross-sectional area through which the primary supply of air passes therethrough. The length of the main air passage 132 is predetermined to allow fuel and air premixing prior to combustion within the combustor 40. The total predetermined effective air flow area or cross-sectional area of the main air passages 132 is about equal to the total effective air flow area of the preestablished cooling area 70. Thus, a means 133 for introducing a primary supply of air through the injector 66 is formed. The means 133 for introducing the primary supply of air through the injector 66 includes the main air passage 132, the spacing between the swirlers 102, the first chamber 130, the passage 74 and the source or supply of air. In addition a variable amount of secondary air can be introduced into the first chamber 130 and the main air passages 132 through the passage 74.

A first gaseous main fuel gallery or annular groove 134 is defined intermediate the first and second ends 114,116 of the main body 112 and extends radially inwardly from the external surface 118 of the main body 112 a preestablished distance. A portion of the shell 126 is positioned over a portion of the external stepped surface 118 in sealing relationship and further defines the first annular groove 134. A main gas passage 136 communicates between the first annular groove 134 and the external surface 118 and exits near the first end 114 of the main body 112. A first gas tube or a main gas tube 138 is at least partially positioned within the passage 74 of the tubular member 72 and has a first end portion 140 fixedly attached within the main gas passage 136 near the exit thereof at the external surface 118. A second end 142 of the first gas tube 138 sealingly exits the passage 74 through the wall of the tubular member 72 and has a threaded fitting 144 attached thereto for communicating with a source of gaseous combustible fuel, not shown. A plurality of holes 148 are radially spaced about the shell 126 and communicate between the first annular groove 134 and the second chamber 132. A plurality of hollow cylindrical spoke members 150, each have a preestablished length, a first end 152 which is closed and a second end 154 which is open are positioned in the plurality of holes 148 and extend radially outward from the shell 126. The spoke members 150 each have a plurality of passages 156 therein which are axially spaced along the cylinder. The plurality of passages 156 are positioned in such a manner so as to inject gaseous fuel in a predetermined manner into the second chamber 132 and the first closed end 152 is positioned radially inwardly from the inner surface 90 of the casing 86. The plurality of passages 156 are in fluid communication with the hollow portion of the cylindrical spoke member 150, the first annular groove 134 and the main gas passage 136. Thus, a means 160 for passing the main source of fuel through the injector 66 is formed. The means 160 for passing the main source of fuel includes the main air passage 132, the plurality of spoke members 150, the first annular groove 134, the main gas passage 136, the first gas tube 138 and the source of gaseous combustible fuel.

A pilot chamber 164 is defined by the concave surface 124 within the internal configuration of the end cap 110 of the inner member 108. The second end 122 of the end cap 110 has a plurality of exit passages 168, radially spaced thereabout, defined therein and in fluid communication with the pilot chamber 164. Each of the plurality of exit passages 168 is at an outwardly diverging oblique angle to the central axis 68 of the injector nozzle 66. A pilot gas passage 170 communicates between the pilot chamber 164 and the external surface 118 of the main body 112 near the first end 114 of the main body 112. A second gas tube or a pilot gas tube 172 is at least partially positioned within the passage 74 of the tubular member 72 and has a first end 174 fixedly attached within the pilot gas passage 170 near the exit thereof at the external surface 118. A second end 176 of the second gas tube 172 sealingly exits the passage 74 through the wall of the tubular member 72 and has a threaded fitting 178 attached thereto for communicating with a source of gaseous combustible fuel, not shown. The source of gaseous combustible fuels may be the same or an alternate sources from that supplied to the main gas passage 136. Thus, a means 179 for passing the pilot fuel through the injector 66 is formed. The means 179 for passing the pilot fuel includes the plurality of exit passages 168, the pilot gas passage 170, the second gas tube 172 and the source of gaseous combustible fuel.

A set of swirlers 180 each having a preestablished length and shape are generally evenly spaced and positioned between the shell 126 and the end cap 110. The set of swirlers 180 are spaced from a vertical portion 181 of the external stepped surface 118 a preestablished distance and define a second annular grove or air gallery 182 between the vertical portion 181 of the external stepped surface 118, the shell 126 and the set of swirlers 180. A pilot air passage 184 having a predetermined area, being approximately 5 percent of the total air flow area, communicates between the second annular groove 182, the first end 114 of the main body 112 and further passes through the plate 96. In this application the predetermined total areas of the passage 32 and the pilot passage 184 are equal to approximately 95 and 5 percent respectively of the total maximum flow of compressed air passing through the injector nozzle 66. The injector nozzle 66 further includes a means 186 for introducing an air supply or secondary air supply through the injector nozzle 66. The means 186 for introducing includes a dual path one including the plurality of holes 131 in the plate 96, the first chamber 130, the spacing between the swirlers 12 in the main air passage 132 and the other includes a pilot air supply through the injector nozzle 66 the secondary passage 184, the second groove 182 and the spacing between the swirlers 180.

Figure 4:
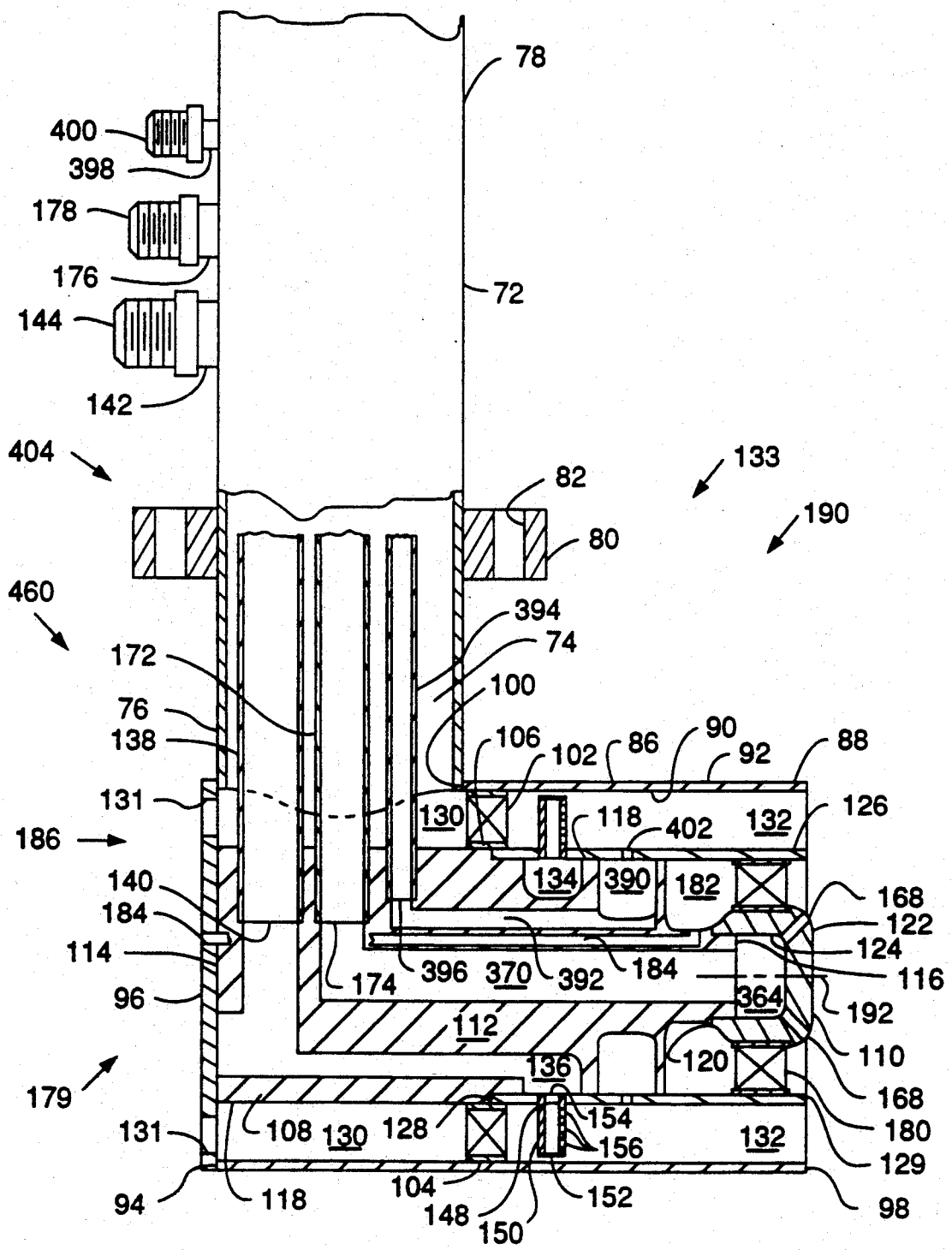
FIG. 4 is an enlarged sectional view of an alternate embodiment of a dual fuel injector used in one embodiment of the present invention.

As an alternative, and best shown in FIG. 4, a dual fuel type injector 190, gaseous and liquid, can be used in place of the single gaseous fuel injector 66. Where applicable, the nomenclature and reference numerals used to identify the dual fuel type injector 190 is identical to that used to identify the single gaseous fuel type injector 66. Each of the injectors 190 has a central axis 192 and is supported from the outer housing 14 in a conventional manner. For example, an outer tubular member 72 has a passage 74 therein similar to that shown in FIG. 3.

A third annular groove or liquid fuel gallery 390 is defined intermediate the first annular groove 134 and the second annular groove 182. A third annular groove or liquid fuel gallery 390 extends radially inwardly from the external surface 118 of the main body 112 a preestablished distance. A portion of the shell 126 is positioned over a portion of the external stepped surface 118 in sealing relationship and further defines the third annular groove 390. A liquid fuel passage 392 communicates between the third annular groove 390 and the external surface 118 and exits near the upstream end 114 of the main body 112. A liquid fuel tube 394 is at least partially positioned within the passage 74 of the tubular member 72 and has a first end portion 396 fixedly attached within the liquid fuel passage 392 near the exit thereof at the external surface 118. A second end 398 of the liquid fuel tube 394 sealingly exits the passage 74 through the wall of the tubular member 72 and has a threaded fitting 400 attached thereto for communicating with a source of liquid combustible fuel, not shown. A plurality of holes 402 are axially spaced between the plurality of holes 148 and the second end 129 of the shell 126. The plurality of holes 402 are generally evenly, circumferentially and radially spaced about the shell 126 and communicate between the third annular groove 390 and the second chamber 132. Thus, a means 404 for passing a source of liquid fuel through the injector nozzle 190 is formed. The means 404 for passing a source of liquid fuel through the injector nozzle 190 includes the source of liquid fuel, the liquid fuel tube 394, the liquid fuel passage 392, the third fuel groove or gallery 390, the plurality of holes 402 and the second chamber 132.

As best shown in FIGS. 1 and 2, the control system 12 for reducing nitrogen oxide, carbon monoxide and unburned hydrocarbon emissions from the gas turbine engine 10 includes a means 460 for directing a portion of the flow of compressed air exiting the compressor section 22 through the injection nozzles 66,190 into the inlet end 54 of the combustor 40. The means 460 for directing a portion of the flow of compressed air includes the outer housing 14 and the inner case 28, the outer shell 50, the inlet end 54 of the combustor 40 and the inner shell 52 of the combustor section 26. The preestablished spaced relationship of the outer and inner shells 50,52 of the combustor 40 to the outer housing 14 and the inner case 28 which forms the preestablished flow area 70 between the combustor 40, and the outer housing 14 and the inner case 26 is also a part of the means 460 for directing.

As best shown in FIGS. 1 and 2, the control system 12 for reducing nitrogen oxide, carbon monoxide and unburned hydrocarbon emissions from the engine 10 further includes a manifold 462 having a passage 464 therein. The manifold 462 is positioned externally of and encircles the outer housing 14. A plurality of openings 466 in the manifold correspond in location to the location of each of the tubular members 72. The tubular members 72 form a part of a means 468 for ducting and are attached in fluid communication with the plurality of openings 466 in the manifold 462. Thus, the tube passage 74 of the tubular member 72 is in fluid communication with the compressed air inside the passage 464 within the manifold 462. The means 468 for ducting include a plurality of elbows, flanges and connectors 470. The manifold 462 further includes at least one primary inlet opening 472 having a duct 474 attached thereto. The duct 474 has a passage 476 defined therein which communicates with the passage 464 within the manifold 462 and the preestablished flow areas 70 between the combustor 40, and the outer housing 14 and the inner case 26 by way of the aperture 19 within the outer housing 14. Attached within the duct 474 is a valve 478. In this application, the valve 478 is of the conventional butterfly type but could be of any conventional design. The valve 478 includes a housing 480 having a passage 482 therein. Further included in the housing 480 is a through bore 484 and a pair of bearings, not shown, are secured in the bore 484. A shaft 486 is rotatably positioned within the bearings and has a throttling mechanism 488 attached thereto and positioned within the passage 482. The shaft 486 has a first end 490 extending externally of the housing 480. A lever 492 is attached to the first end 490 of the shaft 486 and movement of the lever 492 causes the throttling mechanism 488 to move between a closed position 494 and an open position 496.

The control system 12 for reducing nitrogen oxide, carbon monoxide and unburned hydrocarbon emissions further includes a means 498 for controllably varying the amount of air directed into the combustor 40. The means 498 for controllably varying is operatively positioned between the source of compressed air 22, in this application and the combustor 40. The air entering into the injection nozzle 66,190 is restricted or controlled at a minimum flow when the engine 10 is operating at lower power or fuel levels. The means 498 for varying the amount of air directed into the combustor 40 includes the following components. The first chamber 130 and the second chamber 132 having the preestablished area formed between the outer cylindrical casing 86 and the inner member 108 of each injector nozzle 66,190, the passage 74 within the tubular member 72 and the passage 464 in the manifold 462. The passage 476 within the duct 474, the passage 482 in the housing 480 and the throttling mechanism 488 within the passage 482 is included in the means 498 for controllably varying the amount of air directed into the combustor 40.

The the control system 12 for reducing nitrogen oxide, carbon monoxide and unburned hydrocarbon emissions further includes a means 510 for monitoring and controlling the portion of the flow of compressed air controllably directed to the injection nozzle 66,190. The means 510 for monitoring and controlling includes a sensor 512 positioned within the engine 10 which monitors the power turbine 30 inlet temperature. As an alternative, many parameters of the engine such as load, speed or temperature could be used as the monitored parameter. The sensor 512 is connected to a control box or computer 514 by a plurality of wires 516 wherein a signal from the sensor 512 is interpreted and a second signal is sent through a plurality of wires 518 to a power cylinder 520. In this application, the power cylinder 520 is a hydraulically actuated electrically controlled cylinder, but as an alternative could be an electric solenoid or any other equivalent device. The power cylinder 520 moves the lever 492 and the attached throttling mechanism 488 between the open position 496 and the closed position 494. The power turbine 30 inlet temperature is controlled to a preestablished temperature, which corresponds to a combustion temperature in the range of about 2700 to 3200 degrees Fahrenheit, by the valve 478 having the throttling mechanism control the amount of compressed air controllably directed to the injector 66,190. In this application, the movement of the throttling mechanism 488 is infinitely variable between the open position 496 and the closed position 494. However, as an option, the movement of the throttling mechanism 488 can be movable between the closed position 494 and the open position 496 through a plurality of preestablished stepped positions.

Industrial Applicability

In use the gas turbine engine 10 is started and allowed to warm up and is used to produce either electrical power, pump gas, turn a mechanical drive unit or any other suitable application. As the demand for load or power produced by the generator is increased, the load on the engine 10 is increased and the control system 12 for reducing nitrogen oxide, carbon monoxide and unburned hydrocarbon emission is activated. In the start-up and warm-up condition, the throttling mechanism 488 of the valve 478 is positioned in either the partly open 496 or closed 494 position and the minimum amount of compressed air is directed into the injection nozzle 66,190 and the minimum amount of compressed air enters the combustor 40. During the start-up and warm-up condition the engine is in a high emissions mode and uses primarily pilot fuel. For example, a large fraction of the compressed air from the compressor section 22 flows between the outer housing 14 and the inner case 28 into the preestablished flow or cooling area 70 formed between the outer housing 14 and the inner case 28 less the area of the combustor section 26. A small portion of the compressed air from the compressor section 22 flows through the pilot passage 184 into the second annular groove 182 and exits through the swirlers 180 into the combustor 40. When pilot fuel is being used, fuel enters through the second gas tube 172 and travels along the pilot gas passage 170 into the pilot chamber 164. From the pilot chamber 164, the pilot fuel exits through the plurality of exit passages 168 and intermixes with the small portion of compressed air entering through the secondary passage 184 in the injector nozzle 66,190. An additional significant portion of the compressor primary air, which is constant, also enters through the plurality of holes 131 in the end plate 96, communicates with the first chamber 130 passes through the plurality of swirlers 102 into the second chamber 132 and exits into the combustor 40. The primary air which has entered through the plurality of holes 131 further mixes with the pilot fuel and air mixture within combustor 40 and supports combustion during the high emissions mode. In this mode the remainder of the air from the compressor flows through the preestablished flow area 70. At full power nearly all the fuel is introduced through and very little fuel passes through the passage 168. Premixing in the main air passage 132 reduces NOx emissions.

With the throttling mechanism 488 in the fully open position 496, the maximum allowable flow of compressed air is drawn from the preestablished flow area 70 and is directed through the openings 19 in the outer housing 14 into the passage 476 within the duct 474 through the valve 478 and into the passage 464 within the manifold 462. From the passage 464, the primary air is communicated into the tube passages 74 within the tubular members 72 and into the injector nozzles 66,190. The primary air entering into the tube passage 74 is variable depending on load.

In the single gaseous fuel type injector nozzle 66 and the dual fuel type injector nozzle 190, the position of the throttling mechanism 488 intermediate the closed position 494 and the open position 496 determines the amount of primary air from the compressor section 22 that is to be mixed with the main fuel within the injector nozzle 66,190. As the load on the engine 10 is increased, the amount of fuel required by the engine 10 increases and the amount of air required also increases. A predetermined schedule transfers fueling from the passage 168 to the spoke members 150. For example, the control system 12 regulates the throttling mechanism 488 as it moves toward the fully open position 496 in a predetermined relationship to that of the fuel position and the temperature within the combustor 40. The fuel/air ratio is controlled and regulated depending on the temperature within the power turbine and the combustor 40. Thus, the fuel/air ratio and the temperature within the combustor 40 is controlled and the formation of nitrogen oxide, carbon monoxide and unburned hydrocarbon is minimized.

Other aspects, objectives and advantages of this invention can be obtained from a study of the drawings, the disclosure and the appended claims.

We claim:

1. An injector nozzle having a central axis, said injector nozzle comprising;

a generally cylindrical outer casing being coaxially positioned about the central axis and having a first end, a second end and a wall defining an inner surface and an outer surface, said wall further defining an aperture therein extending between the inner surface and the outer surface and positioned near the first end;

an outer tubular member having a passage therein and being positioned in the aperture and attached to the casing;

a plate positioned at the first end and being attached to the casing, said plate having a plurality of secondary passages therein;

an inner member being coaxially positioned about the central axis within the outer casing and including a main body having a first end attached to the plate, a second end and an external stepped surface, an end cap having a first end attached to the second end of the main body, a second end and a concave inner surface, and a generally cylindrical shell coaxially positioned about the central axis, having a first end attached to the external stepped surface intermediate the first and second ends thereof, a second end and a plurality of holes being radially positioned and evenly spaced about the shell;

means for passing a pilot fuel through the injector nozzle during operation thereof;

means for introducing a supply of pilot air through the injector nozzle, said supply of pilot air being mixed with the pilot fuel only after exiting the injector nozzle during operation thereof;

means for introducing a primary supply of air through the injector nozzle during operation thereof, said means for introducing the primary supply of air including a main air passage being defined by a portion of the inner surface of the wall and a portion of the shell; and means for passing a main source of fuel through the injector nozzle during operation thereof, said means for passing the main source of fuel including a plurality of spoke members disposed within respective ones of the plurality of holes and being partially positioned within the main air passage and having a plurality of passages therein exiting into the main air passage.

2. The injector nozzle of claim 1 wherein said pilot fuel is a gaseous fuel.

3. The injector nozzle of claim 2 wherein said means for passing a pilot fuel through the injector nozzle includes a plurality of exit passages positioned in the second end of the end cap, a pilot chamber defined within the end cap, a pilot gas passage positioned within the main body and communicating between the pilot chamber and a pilot gas tube which is in fluid communication with the source of gaseous combustible fuel.

4. The injector nozzle of claim 3 wherein said plurality of exit passages are radially spaced about the second end of the end cap.

5. The injector nozzle of claim 1 wherein said means for introducing a supply of pilot air through the injector nozzle has a predetermined total area through which the pilot air passes.

6. The injector nozzle of claim 1 wherein said means for introducing a supply of pilot air through the injector nozzle includes an air gallery positioned within the main body, a secondary passage and a plurality of holes positioned in the plate, said secondary passage and said plurality of holes each have a predetermined area and together form a preestablished total maximum area for the flow of pilot air, said pilot flow of air being approximately 5 percent of the total maximum flow of air passing through the injector nozzle.

7. The injector nozzle of claim 1 wherein said main air passage has a predetermined cross-sectional area through which the primary supply of air passes therethrough, said predetermined cross-sectional being about 95 percent of the predetermined total area for the flow of primary air.

8. The injector nozzle of claim 1 wherein said means for introducing the primary supply of air through the injector further includes the spacing between the swirlers, the first chamber and the passage.

9. The injector nozzle of claim 1 wherein said main source of fuel is a gaseous fuel.

10. A dual fuel injector nozzle having a central axis, said injector nozzle comprising;

a generally cylindrical outer casing being coaxially positioned about the central axis and having a first end, a second end and a wall defining an inner surface and an outer surface, said wall further defining an aperture therein extending between the inner surface and the outer surface and positioned near the first end;

an outer tubular member having a passage therein and being positioned in the aperture and attached to the casing;

a plate positioned at the first end and being attached to the casing, said plate having a plurality of secondary air passages therein;

an inner member being coaxially positioned about the central axis and including a main body having a first end attached to the plate, a second end and an external stepped surface, an end cap having a first end attached to the second end of the main body, a second end and a concave inner surface, and a generally cylindrical shell coaxially positioned about the central axis, having a first end attached to the external stepped surface intermediate the first and second ends thereof, a second end and a plurality of holes being radially positioned and evenly spaced about the shell;

means for passing a pilot fuel through the injector nozzle;

means for introducing a supply of pilot air through the injector nozzle, said supply of pilot air being mixed with the pilot fuel only after exiting the injector nozzle;

means for introducing a primary supply of air through the injector nozzle, said means for introducing the primary supply of air including a main air passage being defined by a portion of the inner surface of the wall and a portion of the shell;

means for passing a main source of gaseous fuel through the injector nozzle, said means for passing a main source of gaseous fuel including a plurality of spoke members disposed within respective ones of the plurality of holes and being partially positioned within the main air passage and having a plurality of passages therein exiting into the main air passage; and means for passing a source of liquid fuel through the injector nozzle, said means for passing the source of liquid fuel including a plurality of holes generally evenly circumferentially spaced about the shell and positioned intermediate the plurality of spoke members and the second end.

11. The injector nozzle of claim 10 wherein said pilot fuel is a gaseous fuel.

12. The injector nozzle of claim 11 wherein said means for passing a pilot fuel through the injector nozzle including a plurality of exit passages positioned in the second end of the end cap, a pilot chamber define within the end cap, a pilot gas passage positioned within the main body and communicating between the pilot chamber and a pilot gas tube which is in fluid communication with the source of gaseous combustible fuel.

13. The injector nozzle of claim 12 wherein said plurality of exit passages are radially spaced about the second end of the end cap.

14. The injector nozzle of claim 10 wherein said means for introducing a supply of pilot air through the injector nozzle has a predetermined total area through which the pilot air passes.

15. The injector nozzle of claim 10 wherein said means for introducing a supply of pilot air through the injector nozzle includes a second annular groove positioned within the main body, a secondary passage and a plurality of holes positioned in the plate, said secondary passage and said plurality of holes each have a predetermined area and together form a preestablished total maximum area for the flow of pilot air, said flow of pilot air being approximately 5 percent of the total maximum flow of air passing through the injector nozzle.

16. The injector nozzle of claim 10 wherein said main air passage has a predetermined cross-sectional area through which the primary supply of air passes, said predetermined cross-sectional being about 95 percent of the predetermined total area for the flow of primary air.

17. The injector nozzle of claim 10 wherein said means for introducing the primary supply of air through the injector further including the spacing between the swirlers, the first chamber and the passage.

* * * * *